United States Patent [19]

Dineen et al.

[11] Patent Number: 5,040,755

[45] Date of Patent: Aug. 20, 1991

[54] GARBAGE BAG HOLDING AND STORAGE FRAME

[75] Inventors: Paul A. Dineen, 383 Sackville Street, Toronto, Ontario, Canada, M5A 3G5; Leonard R. Cunningham, Toronto, Canada

[73] Assignee: Paul A. Dineen, Toronto, Canada

[21] Appl. No.: 474,375

[22] Filed: Feb. 2, 1990

[30] Foreign Application Priority Data

Mar. 1, 1989 [CA] Canada ..... 592393

[51] Int. Cl.[5] ..... B65B 67/04

[52] U.S. Cl. ..... 248/99

[58] Field of Search ..... 248/95, 99, 100, 97, 248/98

[56] References Cited

U.S. PATENT DOCUMENTS

| | | | |
|---|---|---|---|
| 3,467,989 | 8/1984 | Stroh . | |
| 4,469,300 | 9/1984 | Valesko . | |
| 4,537,377 | 8/1985 | Shewchuck . | |
| 4,664,455 | 5/1987 | Greenrow | 248/99 |
| 4,802,647 | 2/1989 | Celmayster | 248/99 |

*Primary Examiner*—Robert L. Wolfe

*Attorney, Agent, or Firm*—Riches, McKenzie & Herbert

[57] ABSTRACT

An improved bag holder formed of wire is disclosed. The holder is particularly useful for holding bags with handles and particularly useful when the bag is used as a garbage bag. The invention takes advantage of the flexure and resiliency characteristics of wire. In a preferred embodiment of the invention, a neck is provided on which to store unused bags. In a further embodiment of the invention, a unique manner is provided for keeping the held bag closed in order to reduce the emission of unwanted odors.

34 Claims, 3 Drawing Sheets

FIG. 2
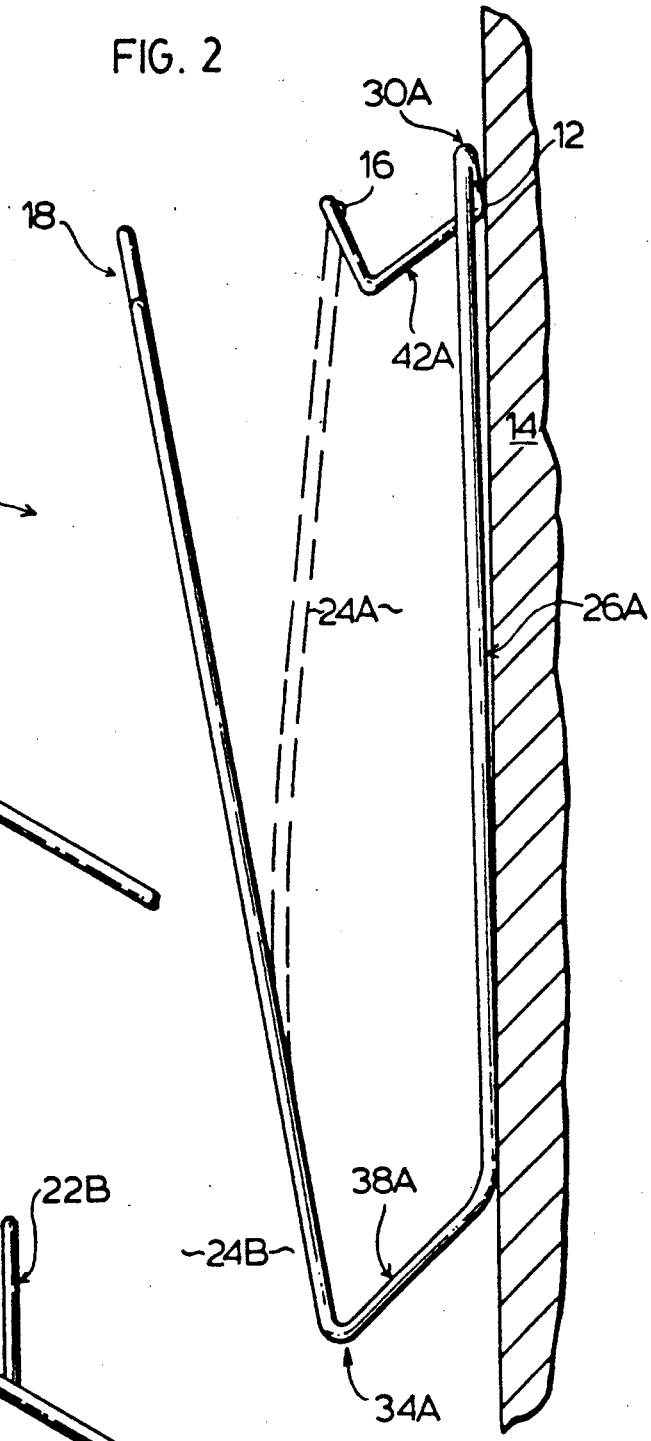
FIG. 3
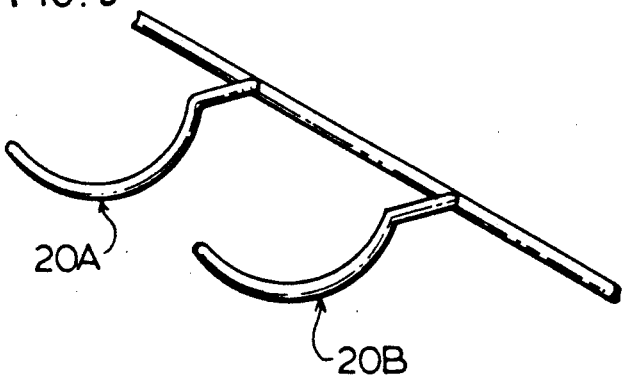
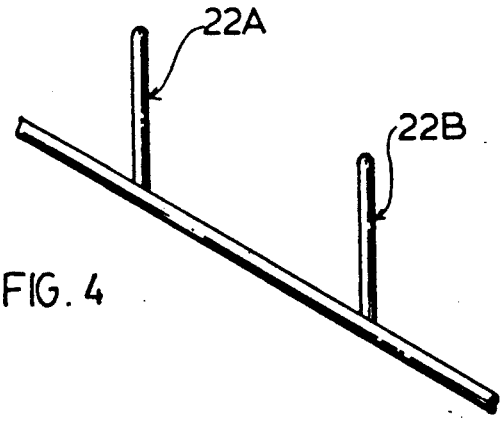
FIG. 4

GARBAGE BAG HOLDING AND STORAGE FRAME

BACKGROUND OF THE INVENTION

This invention relates to a bag holder formed from wire. The invention has particular application to bags with handles and special application to plastic bags with handles used as garbage bags.

In the past, there have been many types of bag holders. However, the prior art bag holders were complicated to make or use. Many of the prior art bag holders did not allow the bag to be closed. Also, the prior art holders do not appear to have provided any convenient place to store unused bags and to store those bags in a neat fashion.

SUMMARY OF THE INVENTION

Accordingly, it is an object of this invention to provide an improved bag holder formed from wire, particularly for holding bags with handles and particularly holding bags as garbage bags.

It is a further object of the invention to provide a bag holder that permits the held bag to be easily closed and opened.

It is a further object of the invention to provide a bag holder that provides a place to store unused bags until it is desired to hold a bag by the bag holder. It is a further object to provide a bag holder that stores the unused bags in a neat fashion.

Accordingly, in one of its broad aspects, the invention resides in providing a bag holder formed from wire that has a front part with a holding means for holding one part of the bag to be held, and a back part with a holding means for holding another part of the bag to be held, and wherein the front and back parts are fixedly connected to each other, but where there is a relative flexure between the front and the back parts.

In a further aspect of the invention, a locking means is provided to lock the held bag in a closed position.

In a further aspect of the invention, a neck means is provided on the bag holder upon which bags can be stored easily by their handles while a first bag is being held by the bag holder. Also, a retaining means is provided for neatly storing the bags.

BRIEF DESCRIPTION OF THE DRAWINGS

The invention and its aspects will be more easily understood after reading the following disclosure and reviewing the drawings, in which:

FIG. 2 is a side view of the preferred embodiment as shown in FIG. 1;

FIG. 3 is a partial view of one part of an embodiment of the invention;

FIG. 4 is a partial view of one part of a preferred embodiment of the invention.

DETAILED DESCRIPTION OF THE INVENTION AND PREFERRED EMBODIMENTS THEREOF

The bag holder of the invention can be used to hold any sort of suitable bag. Preferably, bags with handles can be held by the bag holder. The invention has particular application for holding plastic bags with handles of the type that are often distributed from stores. These bags can be used as garbage bag.

It is desirable to have some place convenient to store the bags when they are brought to a person's home and before they are actually used as garbage bags.

Usually the bag holder of the invention would be attached to the back side of a cupboard door, often below the kitchen or bathroom sink.

Figure 1:
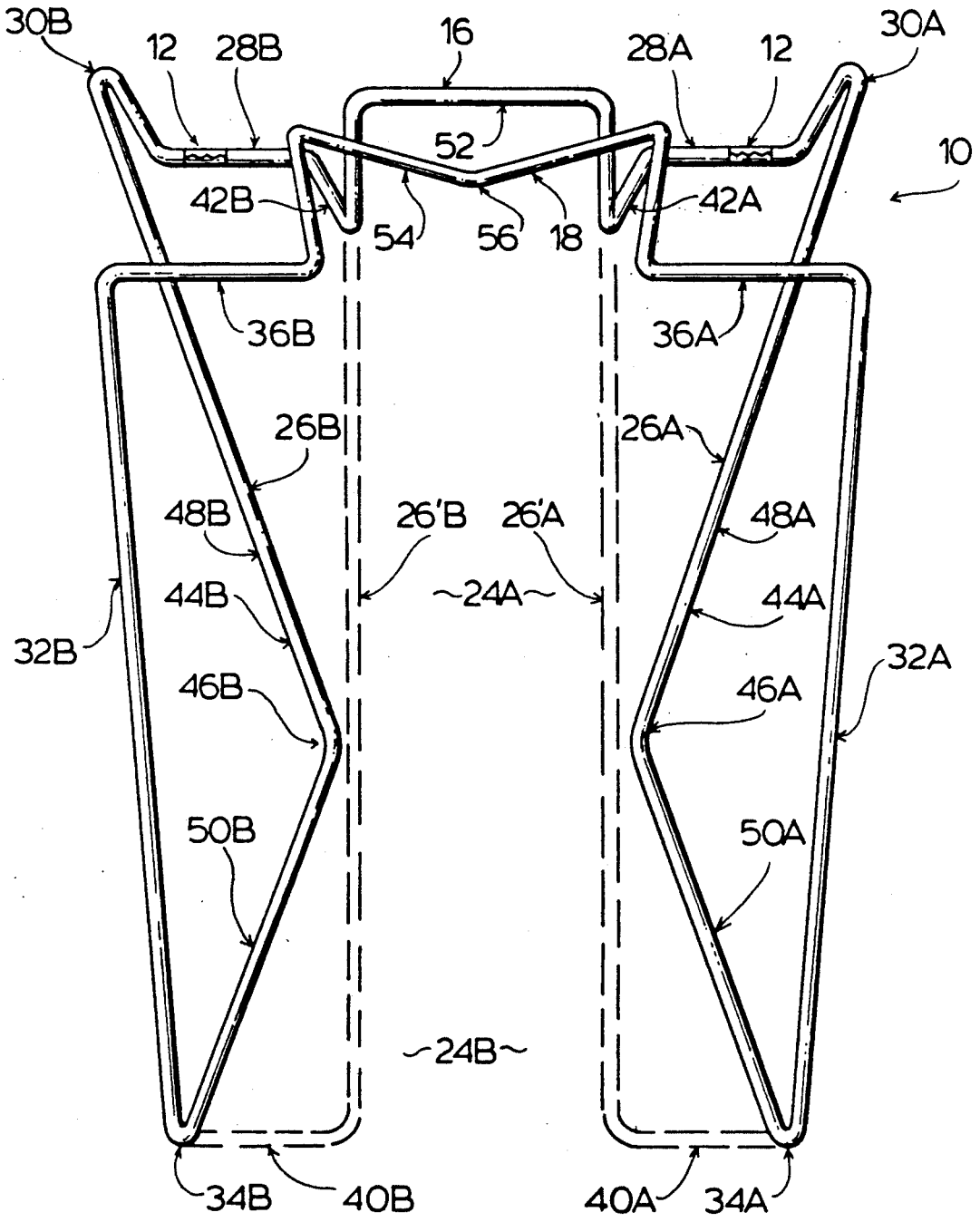
FIG. 1 is a front view of a preferred embodiment of the invention.

A preferred embodiment of the bag holder is shown as 10 in FIG. 1 which is a front view of the bag holder 10. The bag holder 10 is attached by suitable attaching means 12 to a location, preferably a wall 14, as shown in FIG. 2. The attaching means could be, for example, hooks, clips, screws or VELCRO* touch fasteners.

Figure 5:
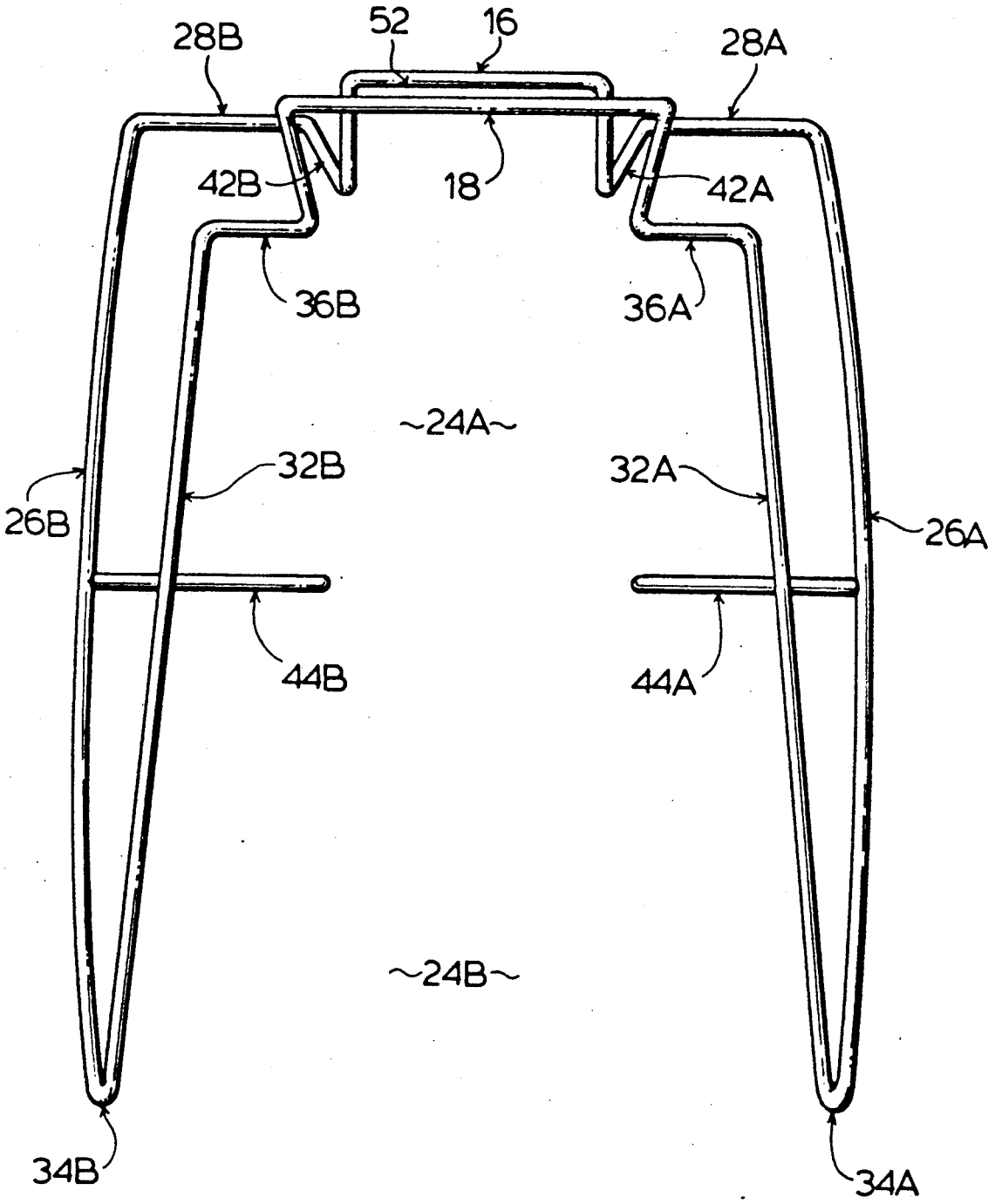
FIG. 5 is a front view of a preferred embodiment of the invention.

A first holding means 16 for holding a bag faces opposite to a second holding means 18 for holding the bag. Preferred embodiments of the first and second holding means 16, 18 are shown in FIGS. 1 and 5. The first and second holding means could be any sort of suitable means to hold a bag. For example, they could be clips if the bag has no handles. If the bag does have handles, the holding means could be, for example, curled hooks 20, either singly or as pairs, as shown in FIG. 3, or extending fingers 22 as shown in FIG. 4.

In the preferred embodiment of the invention as shown in FIG. 1, the holding means 16, 18 are hooking means to fit through the handle of the bag. The first holding means 16 fits within one handle. Or, viewed the other way, because the bag holder 10 will usually be fixed in one location, such as against wall 14, one handle of * Trade Mark the bag fits over the first holding means 16 and the second handle of the bag fits over the second holding means 18.

The preferred holding means 16, 18 are inverted, U-shaped members. The handles of the bag fits over the holding means 16, 18 and the held bag hangs by gravity generally in the region designated 24A in FIG. 2 and possibly extending down through region 24B. Thus, when the bag is hung from the holding means 16, 18 it is normally open or at least partially open. However, it is possible to configure the bag holder 10 of the invention such that when the bag holder 10 is in its "natural position", the holding means 16, 18 are very close to each other, or even touching each other such that the bag would be effectively normally closed. However, it is comtemplated that the usual "natural position" of the bag holder will be such that the bag would be held in an open position.

The "natural position" of the bag holder 10 is intended to mean the position of the bag holder 10 without any forced flexure of any part of the bag holder 10.

Returning to the preferred embodiment of the bag holder 10 as shown in FIG. 1, a first back member 26A extends generally downwardly from the first holding means 16, and a second back member 26B extends generally downwardly from the first holding means 16. Although the back members 26 could extend straight downwardly or vertically downwardly, they may also curve as shown in FIG. 1.

In FIG. 1, the back members 26A, 26B are connected to first holding means 16 through transverse members 28A, 28B (which are described below) and extended shoulder means 30A, 30B (which are described below). However, the back members 26A, 26B can be connected directly to and extend directly from the first holding means 16, for example, as illustrated with dashed lines as members 26'A and 26'B in FIG. 1.

The first back member 26A is fixedly connected to first front member 32A in the region 34A and second back member 26B is fixedly connected to second front member 32B in the region 34B.

One preferred means of fixedly connecting the back members 26A, 26B to the front members 32A, 32B is by welding. However, any other suitable means such as bolts or screws could also be used. However, the most prefered manner of connecting these members is to have the first front member 32A integrally formed with the first back member 26A, and to have the second front member 32B integrally formed with the second back member 26B.

First front member 32A extends generally upwardly and is connected to the second holding means 18. Similarly, the second front member 32B extends generally upwardly and is connected to the second holding means 18.

As can best be seen in FIG. 2, preferably the front members 32A, 32B cross through the area where the bag held by the holding means 16, 18 would naturally tend to hang. Therefore, in the preferred embodiment as shown as FIG. 1, the front members 32A, 32B are connected indirectly to the second holding means 18 through spacing members 36A, 36B, respectively. The purpose of the spacing members 36A, 36B is to maintain a space between front members 32A, 32B that is wide enough to allow a bag to fall freely and without impediment between the two front members 32A, 32B.

Also, the front members 32 and the back members 26 are not necessarily longer than the length of a bag held by the holding means 16, 18. Therefore, the region 24B, as well as 24A, should be free from interference by front members 32 or back members 26.

Similarly, in order to ensure that region 24B remains unimpeded, the regions 34A where the first front member 32A and the first back member 26A are connected, and the region 34B where the second front member 32B and the second back member 26B are connected, should be spaced apart.

On the other hand, there are applications where it would be desirable to have the connecting regions 34A, 34B in approximately the location of the lowermost portion of the held bag in order to give additional support to the bag. This could be useful when the bag was used to collect heavy items. In this application, a cross bar (not shown) extending between regions 34A and 34B might be useful.

A particularly important aspect of this invention is the relative flexure between the first back member 26A and the first front member 32A, and the relative flexure between the second back member 26B and the second front member 32B. This flexure allows the back and front members 26, 32 to move towards and away from each other and, consequently, allows the first and second holding means 16, 18 to move towards and away from each other, and return to their original positions.

By having the holding means 16, 18 capable of moving towards or away from each other, the held bag can be kept in a conveniently open position.

If the bag holder 10 is configured such that the "natural" or unflexed position of bag holder 10 results in the two holding means 16, 18 being separated from each other by about the same distance as the diameter of the bag, the bag can be held in the open position. However, in order to assist in placing the bag to be held on the bag holder 10, the second holding means 18 can be pushed by the user toward the first holding means 16. In this pushed position it is easier to secure the bag to the holding means 16, 18 whether it is by way of clips, the inverted U-shaped member as shown in FIG. 1, or other suitable means.

When the push on the second holding means 18 is removed, the second holding means 18 returns to its natural position which is spaced apart from the first holding means 16 and which is sufficient to hold the bag in an open position.

If it is desired to hold the bag in a more secure fashion, the natural position of the bag holder 10 can be configured such that in the natural position, the first and second holding means 16, 18 are separated by a distance slightly greater than the maximum opening of any open bag. In the preferred embodiment where the bag holder 10 is used to hold bags with handles, this distance would be slightly greater than the distance between the two handles.

Thus, in this embodiment when a user is placing a bag to he held on the bag holder 10 and when the push on the second holding means 18 is removed, the front and the back members 32, 26 tend to return to the natural position but cannot quite return to that position because of the constraint of the bag. Therefore, there is a constant tension acting on the bag to keep it in the open position at all times. For example, if a user was attempting to fill the bag with some garbage and accidentally hit the bag, the bag might otherwise be dislodged from the holding means 16, 18. However, with the relative flexure between the front and back members 32, 26 applying a constant tension on the bag, it is less likely that the bag would be accidentally dislodged.

On the other hand, when it is desired to remove the bag from the holder 10, the second holding means 18 can once again be moved towards the first holding means 16. The tension of the bag is thereby lessened or eliminated and the bag can easily be removed from the holding means 16, 18.

The wire selected to make the bag holder 10 of the invention should be flexible and resilient in the sense that when the bag holder 10 has been formed, with ordinary forces applied to the holding means 16 or 18, the holding means 16, 18 will move towards or away from each other, but when the ordinary force is removed, the holding means 16, 18 return to their initial positions.

It has been found that .125 gauge wire is suitable for the invention.

If desired, the wire can be coated with electrostatic powder epoxy.

To assist in providing the flexure between the first front member 32A and the first back member 26A, a first bottom member 38A may be provided (as seen in FIG. 2) which allows for two bends in the wire which may better distribute the stress and strain associated with flexing the front and back members 32, 26. A similar bottom member can be provided between second front member 32B and second back member 36B. This embodiment is particularly useful when a front member and a respective back member are formed integrally from one piece of wire.

In order to better yet distribute stress and strain throughout the areas where the front and back members are connected, when respective front and back members are integrally formed from one piece of wire, the respective front and back members can be formed into a half loop or even a full loop to, in effect, provide a coil of a spring or a part thereof.

A further embodiment of the invention, the first holding means 16 is connected to the first back member 26A through a first transverse member 28A extending generally transversely from the first holding means 16. Also, the first holding means 16 is connected to the second back member 26A through a second transverse member 28B extending generally transversely from the first holding means 16 to the second back member 26B.

The transverse members 28 serve to give lateral stability to the bag holder 10.

Also, it is possible to have lateral stability members at other locations of the bag holder 10, such as members 40A, 40B at the bottom of alternate back members 26'A, 26'B.

In a further embodiment of the invention, a bag storage means is provided with the bag holder 10. Preferably, the bag storage means is a neck means 42 connected to the first holding means 16 and extending generally rearwardly and connecting with the back members 26. Thus, the first holding means 16 is connected to the back members 46 through the neck means 42.

The neck means 42 is particularly suited for storing bags with handles. Typically, a bag has two handles and the bag is stored by placing the two handles of the bag over the first holding means 16. The bag is then pushed over the first holding means 16 and onto the neck means 42 where it will be stored.

Depending on the length of the neck means 42, the neck means 42 can store a few or many bags. For example, ten or thirty bags could easily be stored on a neck means 42 that was about 2 inches long.

Thus, when a shopper returns from shopping and has several bags, say five or six, all of those bags can be placed onto the neck means 42 and stored until another bag is needed to be held by the bag holder 10.

When a new bag is required to be held, for example, held as a garbage bag, the last bag to have been placed on the neck means 42 is removed by simply pulling the bag along the neck means 42. One handle of the bag is then removed from the neck means 42 and from the first holding means 16. However, the second handle of the bag can be left held by the first holding means 16 if the first holding means is one as shown in the FIGS. 1 or 5. When the first bag handle is spaced away from the first holding means 16, it is then in a position to be held by the second holding means 18.

Preferably, the neck means 42 has a first neck means 42A extending generally rearwardly from the first holding means 16 to the first back member 26A. Similarly, there is a second neck means 42B that extends generally rearwardly from the first holding means 16 to the second back member 26B.

The neck means 42A, 42B may be connected to the back means 26A, 26B through the transverse members 30A, 30B or through extended shoulder means 30 (described below). It will be understood that when it is said that a member is "connected" to another member, the member may be connected through an intermediate member. For example, the first holding means 16 may be connected to the back members 26, but it may well be connected through the neck means 42, the transverse members 28 or the extended shoulder means 30.

In a preferred embodiment of the invention as best seen in FIG. 2, the neck means 42 and the first and second neck means 42A, 42B extend generally rearwardly and upwardly.

When several bags are stored on the neck means 42, these several bags tend to bulge out into the region 24A. Therefore, it is desirable to retain these several stored bags away from the region 24A and to store the several stored bags in a neat fashion.

Therefore, in order to neatly store the several bags, a retaining means 44A extends inwardly at a generally central region of first back member 26A. In this context, the first back member can be either of the back members on the left or right of the embodiments shown in the Figures. Preferably, there is also a similar retaining means 44B associated with the second back member 26B.

In the embodiment shown in FIG. 5, the retaining means 44A, 44B are lateral members extending inwardly from the back members 26A, 26B.

In order to have easy placement and removal of the stored bags, the retaining means 44 should not completely cover or close in the region 24A.

The retaining means 44 could also be part of the back members 26A, 26B themselves. For example, the first alternate back member 26'A as shown in FIG. 1 could serve as the retaining means 44 because the first alternate back member 26'A extends inwardly to and at a generally central region 46A thereof. Preferably, the second alternate back member 26'B has a similar shape and extends inwardly to and at a generally central region 46B thereof.

In a preferred embodiment of the retaining means 44 as shown in FIG. 1, the retaining means 44A comprises the first back member 26A which extends downwardly and inwardly for a first portion 48A thereof, and downwardly and outwardly for a second portion 50A thereof. The second back member 26B could have a similar shape and extend downwardly and inwardly for a first portion 48B thereof, and downwardly and outwardly for a second portion 50B thereof.

In operation, the retaining means 44 is moved away from the wall 14 and the bags to be stored are placed under the retaining means 44. The retaining means 44 is then allowed to fall back onto the stored bags and retain those bags neatly in place between the retaining means 44 and the wall 14.

In a further embodiment of the invention, a locking means is used to lock the first holding means 16 to the second holding means 18. The locking means is useful when the held bag is being used as a garbage bag and the garbage becomes smelly and unpleasant odors are being emitted from the held bag. In order to at least reduce the extent of bad smells escaping from the held bag, the bag should be closed. The bag can be at least partially closed when the first and second holding means 16, 18 are locked together.

In a preferred embodiment of the invention, the first holding means 16 includes a first inverted, U-shaped hooking means 16 as shown, for example, in FIGS. 1 or 5, and second holding means 18 includes a second inverted, U-shaped hooking means 18 as shown, for example, in FIGS. 1 or 5.

The first hooking means 16 has an outer shape and an outer dimension, and the second hooking means 18 has an inner shape and an inner dimension, wherein the second hooking means 18 is capable of hooking over the first hooking means 16 to lock the first holding means 16 to the second holding means 18.

As shown in FIG. 5, the inverted, U-shaped hooking means 18 is slightly larger than the first inverted, U-shaped hooking means 16. Therefore, the user can push holding means 18 towards holding means 16, and then actually push the second hooking means 18 up, over and behind the first hooking means 16.

Once again, the relative flexure between the front and back members 32, 26 causes the second holding , member 18 to tend to return to its natural position. However, the first holding means 16 prevents this from happening. Therefore, the two holding members 16, 18 are locked in place.

To unlock the two holding members 16, 18, the user lifts the second hooking means 18 up and over the first holding means 16 and the second holding means 18 will naturally return to its unlocked, natural position.

The bottom members 38A, 38B provide an additional vertical component of relative flexure between the front and back members 32, 26 which makes it easier for the user to push the second holding means 18 up, over and behind the first hooking means 16. The first back member 26A is connected to the first front member 32A through first bottom member 38A. A second back member 26B is connected to the second front member 32B through second bottom member 38B.

In a preferred embodiment of the locking means, the first inverted, U-shaped hooking means 16 has a first generally transverse cross-member 52, and the second inverted, U-shaped hooking means 18 has a second generally transverse V-shaped cross-member 54 for locking onto the first cross-member 52. The V-shaped cross-member 54 has a "dimple" 56 that tends to catch the first cross-member 52. This lowers the risk of accidental unlocking. Also, the dimple 56 may have a slight outward curl to it which tends to curl under the first cross-member 52, once again lowering the risk of accidental unlocking.

In a further embodiment of the invention, a pivot-restricting means is provided. When a user tries to lock the two holding means 16, 18 together, the second holding means 18 is brought closer to the first holding means 16 tends to "chase" the first holding means 16. When this happens, the entire bag holder 10 may pivot or rotate about the attaching means 12, depending on where the attaching is located. In this situation, the second holding means 18 is similar to a dog chasing its tail, except that the second holding means 18 is chasing the first holding means 16.

If the attaching means 12 is located at the upper region of the bag holder 10, particularly if the attaching means 12 is a clip or clips, or other suitable means, on the transverse members 28, the bag holder 10 may pivot or rotate depending on the number of attaching means 12.

In order to restrict this pivoting or rotating, pivot-restricting means 30 is provided which restricts the extent to which the bag holder 10 may pivot or rotate about the attaching means 12. Preferably, the pivot-restricted means 30 is an extended-shoulder means 30 which extends upwardly from the region of the first holding means 16 or from the back members 26A, 26B. Preferably, there is a pair of extended-shoulder means 30A, 30B symmetrically spaced from the first holding means 16.

Preferably, the pivot-restricting means 30 does not completely prevent pivoting or rotation. It is desirable to have some pivoting or rotation so that the restraining means 44 can be moved away from the wall 14 when stored bags are placed under the restraining means 44. The bag holder 10 and the restraining means 44 are then allowed to fall back onto the stored bags and to hold the bags in place between the wall 14 and the restraining means 44.

In order that there is partial pivoting or rotation, the pivot-restricting means 30 should be normally spaced away from the rearmost portion or the bag holder 10. For example, as shown in FIG. 2, the rearmost portion of the bag holder 10 is the attaching means 12 on the transverse members 28, and the extended-shoulder means 30A extends from the transverse member 28A at an angle so as to be effectively spaced apart from the rearmost point of the bag holder 10 and spaced apart from the wall 14. Thus, there will be limited pivoting or rotation of the bag holder 10.

In a further embodiment of the invention, the bag holder 10 is integrally formed of one piece of wire. Having the bag holder 10 integrally formed of one piece of wire decreases manufacturing costs and adds to the inherent resiliency of, and flexure between, the various members and components of the bag holder 10.

Although the disclosure describes and illustrates certain preferred embodiments of the invention, it is to be understood that the invention is not restricted to these particular embodiments. The invention includes all embodiments which are functional or mechanical equivalents to the embodiments disclosed and illustrated herein. Having read this disclosure and reviewed the Figures, it will be apparent to persons skilled in the art that there are other embodiments which fall within the scope of this invention and those embodiments are intended to be within the scope of this invention.

What we claim is:

1. A bag holder formed of flexible and resilient wire, comprising:

(a) first and second holding means;

(b) first and second back members; and (c) first and second front members; wherein each of the first and second back members extends generally downwardly from the first holding means;

wherein the first front member is fixedly connected to and extends generally upwardly from the first back member, and the second front member is fixedly connected to and extends generally upwardly from the second back member;

wherein there is relative flexure between the first back member and the first front member, and there is relative flexure between the second back member and the second front member; and wherein the second holding means is connected to each of the first and second front members.

2. A bag holder as defined in claim 1 wherein the first holding means includes a first inverted, U-shaped hooking means and the second holding means includes a second inverted, U-shaped hooking means.

3. A bag holder as defined in claim 1 wherein the first holding means is connected to the first back member through a first transverse member extending generally transversely from the first holding means; and wherein the first holding means is connected to the second back member through a second transverse member extending generally tranversely from the first holding means.

4. A bag holder as defined in claim 2 wherein the first holding means is connected to the first back member through a first transverse member extending generally transversely from the first holding means; and wherein the first holding means is connected to the second back member through a second transverse member extending generally tranversely from the first holding means.

5. A bag holder as defined in claim 1 wherein the first holding means is connected to the back members through a neck means extending generally rearwardly.

6. A bag holder as defined in claim 2 wherein the first holding means is connected to the first back member through a first neck means extending generally rearwardly from the first holding means to the first back member; and wherein the first holding means is connected to the second back member through second neck means extending generally rearwardly from the first holding means to the second back member.

7. A bag holder as defined in claim 6 wherein the first neck means and second neck means each extends generally rearwardly and upwardly.

8. A bag holder as defined in claim 5 further comprising a retaining means extending inwardly at a generally central region of the first back member.

9. A bag holder as defined in claim 8 wherein the retaining means is integrally formed as part of the first back member; and wherein the first back member extends inwardly at a generally central region thereof.

10. A bag holder as defined in claim 9 wherein the first back member extends downwardly and inwardly for a first portion thereof, and downwardly and outwardly for a second portion thereof.

11. A bag holder as defined in claim 6 further comprising a retaining means extending inwardly at a generally central region of the first back member.

12. A bag holder as defined in claim 11 wherein the retaining means is integrally formed as part of the first back member; and wherein the first back member extends inwardly at a generally central region thereof.

13. A bag holder as defined in claim 12 wherein the first back member extends downwardly and inwardly for a first portion thereof, and downwardly and outwardly for a second portion thereof.

14. A bag holder as defined in claim 1 further comprising locking means to lock the first holding means to the second holding means 15. A bag holder as defined in claim 2 wherein the first hooking means has an outer shape and outer dimensions, and the second hooking means has an inner shape and inner dimensions; and wherein the second hooking means is capable of hooking over the first hooking means to lock the first holding means to the second holding means.

16. A bag holder as defined in claim 15 wherein the first hooking means has a first generally transverse cross-member and the second hooking means has a second generally transverse V-shaped cross-member for locking onto the first cross-member.

17. A bag holder as defined in claim 13 wherein the first hooking means has an outer shape and outer dimensions, and the second hooking means has an inner shape and inner dimensions; and wherein the second hooking means is capable of hooking over the first hooking means to lock the first holding means to the second holding means.

18. A bag holder as defined in claim 17 wherein the first hooking means has a first generally transverse cross-member and the second hooking means has a second generally transverse V-shaped cross-member for locking onto the first cross-member.

19. A bag holder as defined in claim 17 further comprising pivot-restricting means for restricting the extent to which the bag holder can pivot about an attaching means for attaching the bag holder to a location.

20. A bag holder as defined in claim 19 wherein the pivot-restricting means comprises extended-shoulder means extending upwardly from a region about the first holding means or a region about a back member.

21. A bag holder as defined in claim 6 wherein the first hooking means has an outer shape and outer dimensions, and the second hooking means has an inner shape and inner dimensions; and wherein the second hooking means is capable of hooking over the first hooking means to lock the first holding means to the second holding means.

22. A bag holder as defined in claim 21 wherein the first hooking means has a first generally transverse cross-member and the second hooking means has a second generally transverse V-shaped cross-member for locking onto the first cross-member.

23. A bag holder as defined in claim 19 wherein the first holding means is connected to the first back member through a first transverse member extending generally transversely from the first holding means; and wherein the first holding means is connected to the second back member through a second transverse member extending generally tranversely from the first holding means.

24. A bag holder as defined in claim 20 wherein the first holding means is connected to the first back member through a first transverse member extending generally transversely from the first holding means; and wherein the first holding means is connected to the second back member through a second transverse member extending generally tranversely from the first holding means.

25. A bag holder as defined in claim 15 wherein the first back member and the first front member are connected through a first bottom member; and wherein the second back member and the second front member are connected through a second bottom member.

26. A bag holder as defined in any of claims 1, 2 or 3 wherein the bag holder is integrally formed from one piece of wire.

27. A bag holder as defined in any of claims 4, 5 or 6 wherein the bag holder is integrally formed from one piece of wire.

28. A bag holder as defined in any of claims 7, 8 or 9 wherein the bag holder is integrally formed form one piece of wire.

29. A bag holder as defined in any of claims 10, 11 or 12 wherein the bag holder is integrally formed from one piece of wire.

30. A bag holder as defined in any of claims 13, 14 or 15 wherein the bag holder is integrally formed from one piece of wire.

31. A bag holder as defined in any of claims 16, 17 or 18 wherein the bag holder is integrally formed from one piece of wire.

32. A bag holder as defined in any of claims 19, 20 or 21 wherein the bag holder is integrally formed from one piece of wire.

33. A bag holder as defined in any of claims 22, 23 or 24 wherein the bag holder is integrally formed from one piece of wire.

34. A bag holder as defined in claim 25 wherein the bag holder is integrally formed from one piece of wire.

* * * * *